US005718607A

United States Patent [19]

Murphy et al.

[11] Patent Number: 5,718,607

[45] Date of Patent: Feb. 17, 1998

[54] SYSTEM FOR TERMINATING THE SHIELD OF A HIGH SPEED CABLE

[75] Inventors: Paul Murphy, Naperville; James C. Cummings, Winfield, both of Ill.; Alejandro McConegly Cota, Tepeyac-Casino, Mexico; Joseph W. Nelligan, Jr., LaGrange Park, Ill.; Michael O'Sullivan, Willowbrook, Ill.; Thomas P. Pellegrino, Lisle, Ill.

[73] Assignee: Molex Incorporated, Lisle, Ill.

[21] Appl. No.: 609,332

[22] Filed: Mar. 1, 1996

[51] Int. Cl.[6] ..... H01R 9/03

[52] U.S. Cl. ..... 439/610; 439/98

[58] Field of Search ..... 439/607, 608, 439/609, 610, 92, 98, 99

[56] References Cited

U.S. PATENT DOCUMENTS

| | | | |
|---|---|---|---|
| 4,615,578 | 10/1986 | Stadler et al. . | |
| 4,813,888 | 3/1989 | Tokizane et al. | 429/583 |
| 5,025,554 | 6/1991 | Dohi | 29/860 |
| 5,061,827 | 10/1991 | Grabbe | 174/756 |
| 5,190,473 | 3/1993 | Mroczkowski et al. | 439/580 |
| 5,197,893 | 3/1993 | Morlion et al. | 439/101 |
| 5,222,898 | 6/1993 | Fedder et al. | 439/101 |
| 5,267,868 | 12/1993 | Wolff, Jr. | 439/610 X |
| 5,304,069 | 4/1994 | Brunker et al. | 439/108 |
| 5,460,533 | 10/1995 | Broeksteeg et al. | 439/610 X |
| 5,495,075 | 2/1996 | Jonckheere et al. | 174/74 |
| 5,509,827 | 4/1996 | Huppenthal et al. | 439/638 |
| 5,525,066 | 6/1996 | Morlion et al. | 439/108 |

FOREIGN PATENT DOCUMENTS

| | | |
|---|---|---|
| 0 385 020 B1 | 7/1996 | European Pat. Off. . |
| 2 718 299 A1 | 6/1995 | France . |

*Primary Examiner*—Khiem Nguyen
*Attorney, Agent, or Firm*—Charles S. Cohen

[57] ABSTRACT

A method is disclosed for terminating the metallic shield of a high speed cable, and including a terminating member used with the method. At least a portion of the outer jacket of the high speed cable is removed to expose a portion of the metallic shield of the cable. The cable is positioned on a conductive terminating member having an opening in registry with the exposed portion of the metallic shield. The shield is soldered to the terminating member through the opening.

41 Claims, 4 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved method of terminating the metallic shield of a high speed cable, as well as a terminal for the shield of the cable.

In the exemplary embodiment of the invention, the method includes the steps of removing at least a portion of the outer jacket of the high speed cable to expose a portion of the metallic shield. A conductive terminating member is provided with a gripping arm having an opening therethrough. The high speed cable is positioned on the terminating member, and the gripping arm is formed into gripping engagement with the high speed cable and with the opening in registry with the exposed portion of the metallic shield. The shield then is soldered to the gripping arm through the opening. In essence, the opening protects the cable from the application of concentrated soldering heat directly to the metallic shield which might damage or disintegrate the underlying inner dielectric. In addition, it facilitates solder flow around the cable shield and the arm.

As disclosed herein, the gripping arm is formed circumferentially about a substantial portion of the high speed cable. The opening in the gripping arm is formed as a circumferentially extending slot. The slot is on the order of 0.040 inch wide to prevent a soldering iron or tool from applying concentrated heat to the metallic shield which might damage the underlying inner dielectric. The conductive terminating member is shown herein as a ground plate having a blade portion with a pair of opposed gripping arms at opposite edges of the blade portion for gripping a pair of high speed cables. Preferably, one pair of the opposed gripping arms are provided on each opposite side of the blade portion of the terminating member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
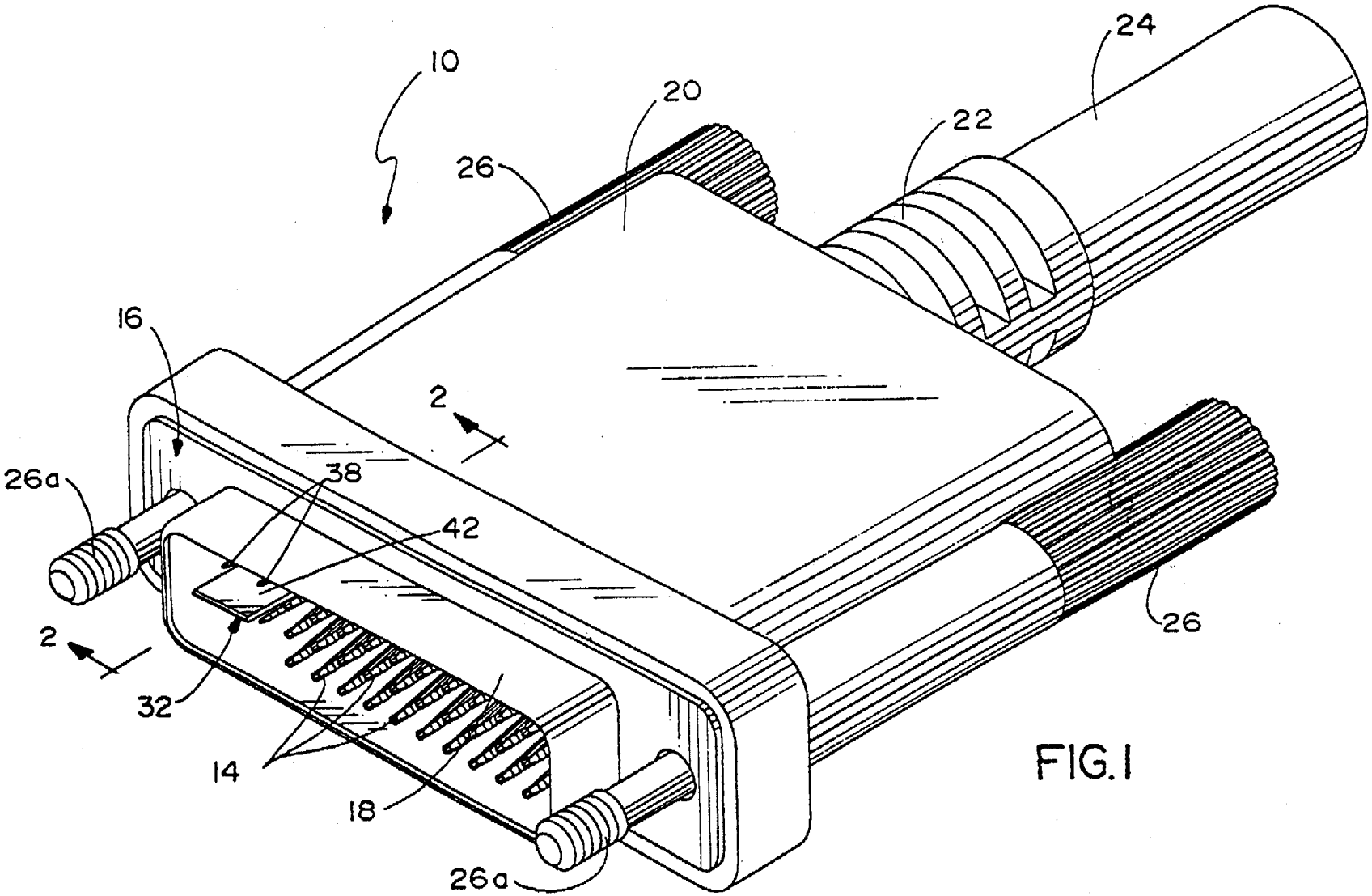
FIG. 1 is a perspective view of an electrical connector of a type in which the invention is applicable.
Figure 2:
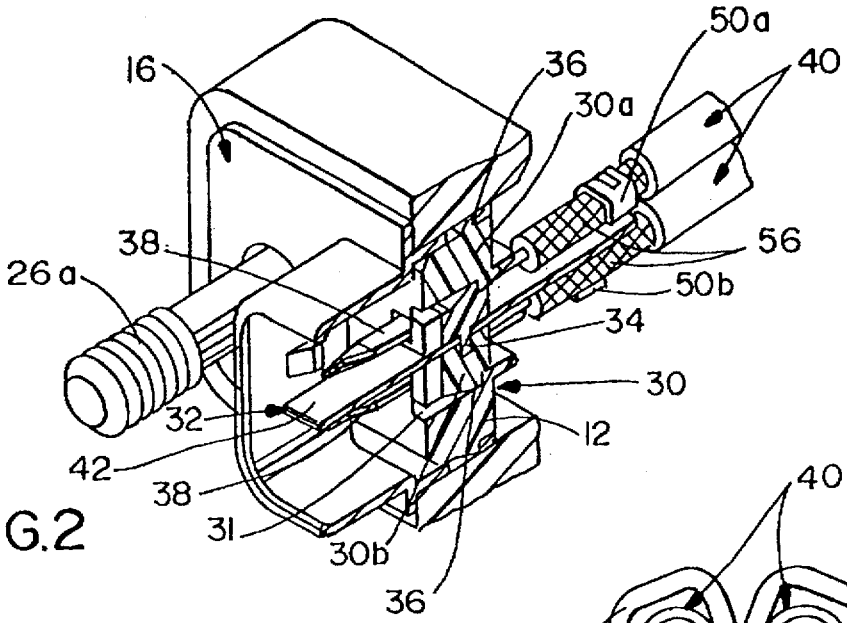
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks 30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36 on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 7) are terminated to the center conductor/cores 52 of a plurality of coaxial cables, generally designated 40 in FIG. 2. The invention is particularly directed to the manner of termination of the metallic shields 56 of the coaxial cables to ground plate 32, as described below.

Figure 3:
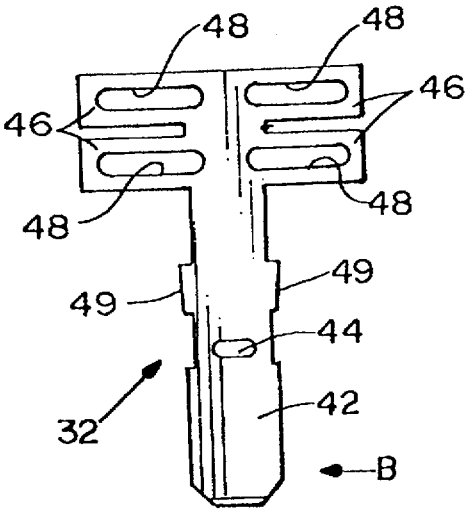
FIG. 3 is a plan view of a stamped metal blank from which the terminating member or ground plate is formed.

More particularly, FIG. 3 shows a blank, generally designated "B," stamped from conductive sheet metal material and from which ground plate 32 is formed. Blank "B" is generally T-shaped and includes a leg or stem portion 42 which will form a blade portion for ground plate 32. The blade portion includes an aperture 44 through which posts 34 (FIG. 2) of terminal blocks 30*a* and 30*b* extend. A pair of wings or arms 46 project outwardly at one end of leg 42 generally at each opposite edge thereof. These wings will form the gripping arms of the ground plate, as will be seen hereinafter. Each wing or gripping arm has an elongated slot 48 to facilitate the solder termination described hereinafter.

When soldering the cable shield 56 to ground plate 32, it is desirable to use a soldering iron having a relatively small tip. Although it is desirable to dimension the slot wide enough to facilitate adequate solder flow throughout the slot, it should be narrow enough to prevent the relatively small tip of the soldering iron from contacting the braid or shield 56 of the cable, which could result in damage to the underlying insulation 54. Each slot is on the order of approximately 0.040 inch wide, although it is believed that such slot could be within the range of 0.110 to 0.010 inch wide. Finally, barbs or teeth 49 are stamped at the opposite edges of blade portion 42 to facilitate holding the subassembly of the ground plate and terminal blocks 30*a* and 30*b* within the housing.

Referring to FIGS. 4–6A, once formed, ground plate 32 is provided with a pair of opposed positioning arms 50*a* at opposite edges of the ground plate for positioning a pair of coaxial cables, as well as providing a pair of the opposed positioning arms 50*a* and 50*b* on each opposite side of the plate. One pair 50*a* is located at the extreme rear distal end of blade portion 42, and the other pair 50*b* is located slightly spaced longitudinally forward of the first pair toward the leading edge of ground plate 32. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals.

Figure 4:
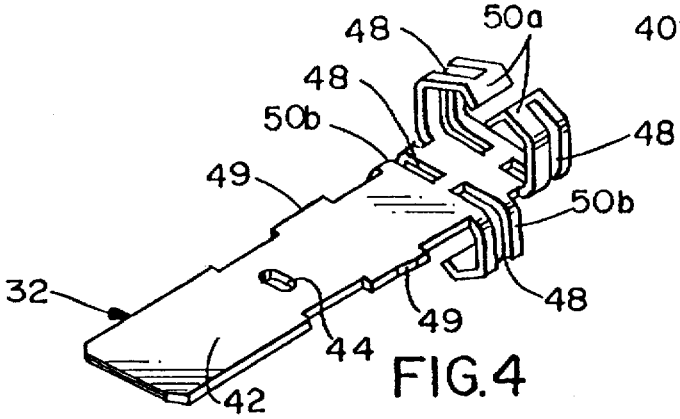
FIG. 4 is a perspective view of the ground plate with the gripping arms partially formed to receive the coaxial cables.

FIG. 4 shows the stamped blank "B" of FIG. 3 with wings 46 having been bent inwardly to form a pair of upper gripping arms 50*a* and a pair of lower gripping arms 50*b*. It can be seen that, after forming, slots 48 in the gripping arms extend in a circumferential direction and into blade portion 42 of ground plate 32. In essence, the ground plate is provided with a pair of opposed gripping arms at opposite edges of the plate for gripping a pair of coaxial cables, as well as providing a pair of the opposed gripping arms on each opposite side of the plate. One pair 50*a* is located at the extreme rear distal end of blade portion 42, and the other pair 50*b* is located slightly spaced longitudinally inwardly of the first pair. With this structure, the ground plate can terminate from one to four coaxial cables depending on the specifications of the connector.

Figure 5A:
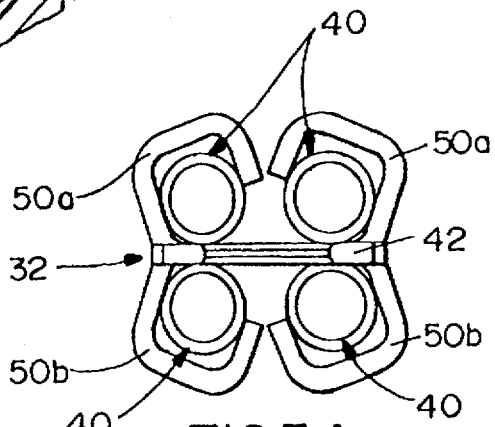
FIG. 5A is an end elevational view looking toward the left-hand end of FIG. 5.
Figure 5:
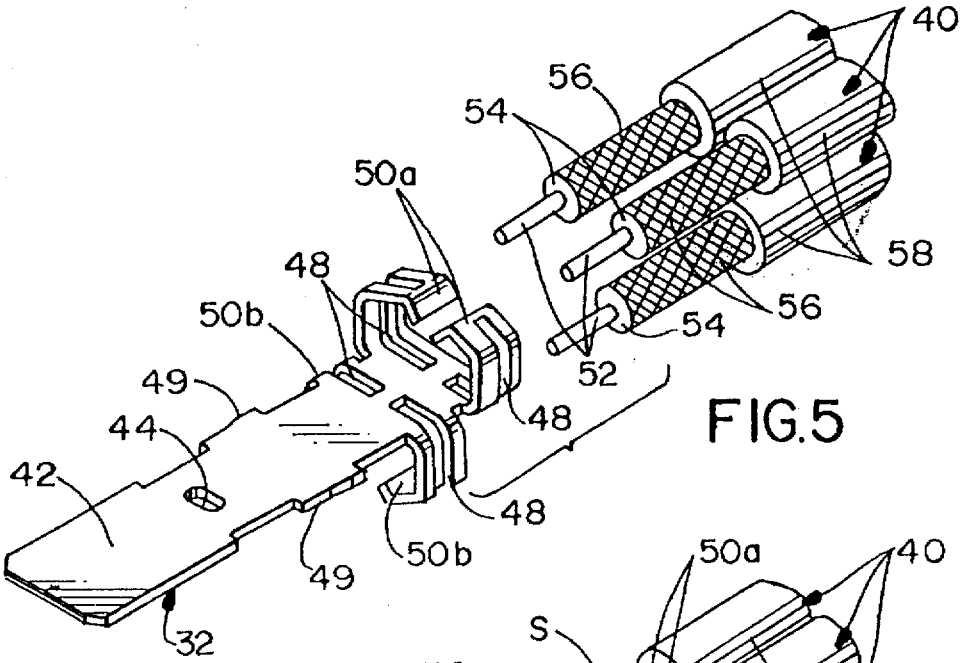
FIG. 5 is a perspective view of the partially formed ground plate in conjunction with a plurality of coaxial cables prepared by removing portions of the outer jackets to expose the metallic shields.

FIGS. 5 and 5A show the partially formed ground plate 32 in conjunction with a plurality of the coaxial cables 40. At this point, it should be understood that each coaxial cable 40 is of a conventional construction in that each cable includes a center conductor or core 52 surrounded by a tube-like inner dielectric material 54. A metallic shield in the form of a tubular metallic braid 56 surrounds inner dielectric 54. An insulating jacket 58, as of plastic or the like, surrounds metallic braid 56 to form the overall composite coaxial cable 40. It should be understood that the principles of the present invention can be applied to the termination of other types of high speed cables, particularly if there is an inner dielectric at least partially surrounded by some type of shield and it is desireable to minimize exposure of the inner dielectric to heat.

Figure 7:
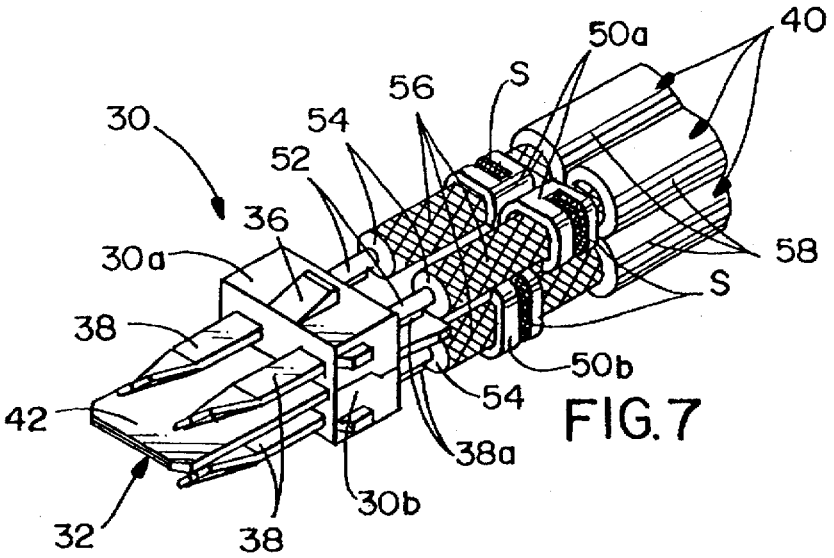
FIG. 7 is a perspective view of the terminal module mountable in the connector of FIGS. 1 and 2.

FIG. 5 shows that center conductor/core 52 of each coaxial cable 40 has been stripped to expose a given length thereof which will be soldered, welded or otherwise secured to the inner ends of high speed signal transmission terminals 38 (FIG. 7). The outer insulating jacket 58 of each cable also has been cut-back to expose a given length of the respective metallic shield 56. Therefore, the exposed shield can be soldered to a respective one of the gripping arms 50*a* or 50*b* of ground plate 32 as discussed below. It should be noted that the metallic shield of each cable is not manipulated in any manner. FIG. 5A shows the prepared coaxial cables inserted in proper alignment within the gripping arms 50*a* and 50*b*.

Figure 6A:
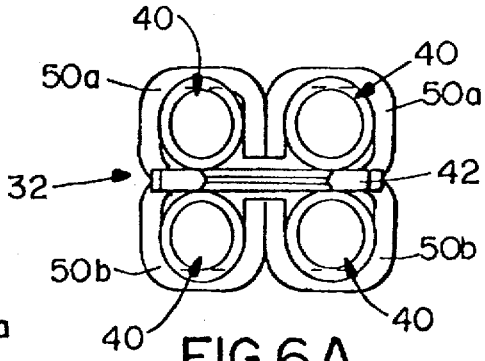
FIG. 6A is end elevational view looking toward the left-hand end of FIG. 6.
Figure 6:
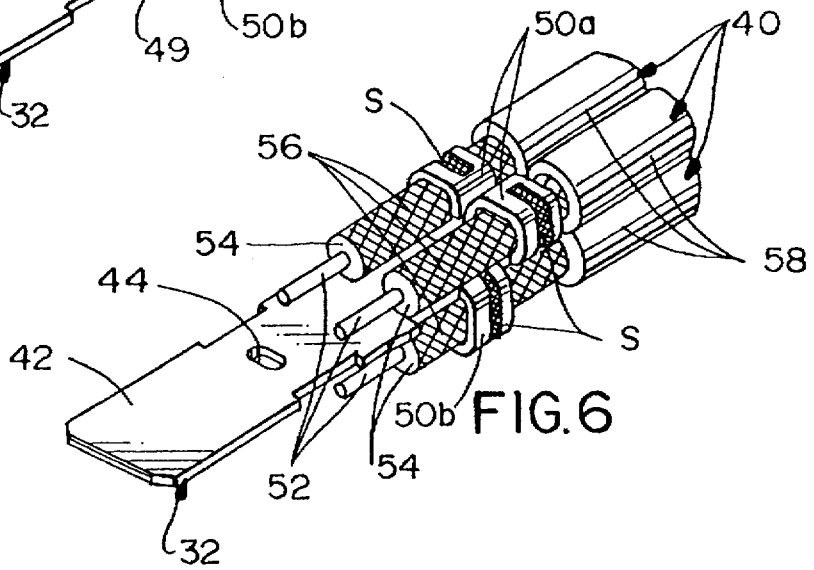
FIG. 6 is a perspective view showing the gripping arms of the ground plate fully formed into gripping engagement about the metallic shields of the coaxial cables.

The next step in processing the terminal module is to move the stripped cables along their axes and into the opening defined by arms 50*a* and 50*b* as well as blade portion 42. Once such stripped cables have been so inserted, the arms 50*a* and 50*b* will generally hold the stripped cables in place until the gripping arms 50*a* and 50*b* are crimped or formed into gripping engagement with the coaxial cables about the exposed metallic shields 56, as shown in FIGS. 6 and 6A. This is best shown by comparing FIG. 6A with FIG. 5A. It should be understood that the gripping arms are not crimped onto the metallic shield as is typical in the crimping art. Rather, an amount of crimping force is used to slightly form the gripping arms inwardly (from FIG. 5A to FIG. 6A), so as to only grip or retain the coaxial cables prior to soldering. The gripping or crimping pressure should not be excessive so as to deform or damage the underlying inner dielectric 54 of cable 40 to any extent, which could affect the electrical performance thereof.

Figure 8:
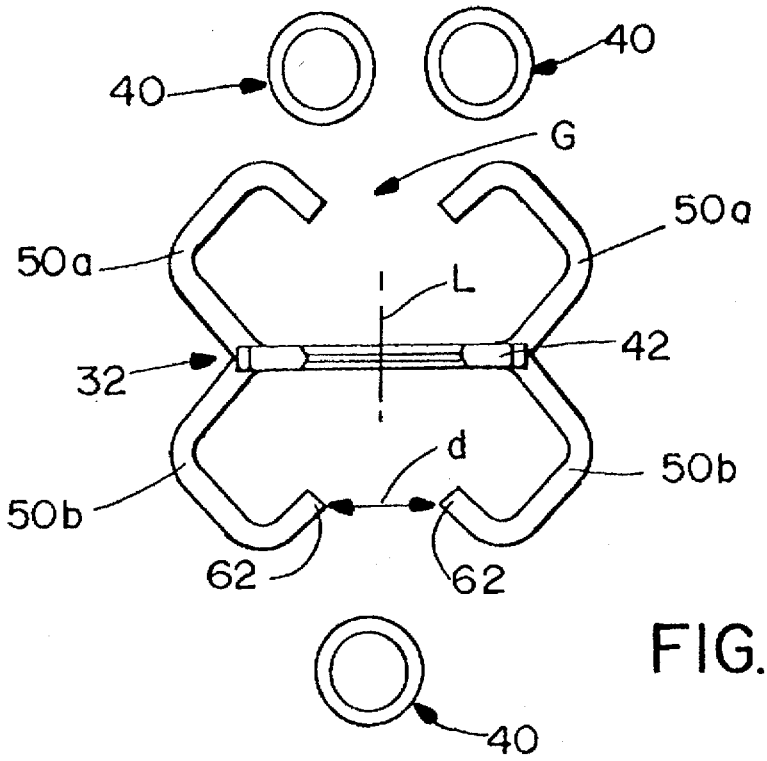
FIG. 8 is an end elevational view similar to FIG. 5A but showing an alternate embodiment of the partially formed ground plate in conjunction with a plurality of coaxial cables prepared by removing portions of the outer jackets to expose the metallic shields.
Figure 9:
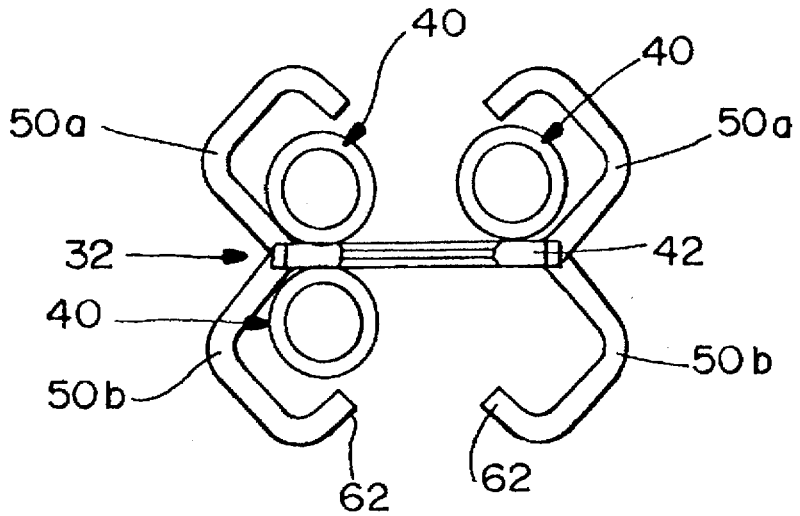
FIG. 9 is an end elevational view similar to FIG. 8 but showing some of the coaxial cables inserted into the partially formed ground plate.

An alternate embodiment of the partially formed ground plate is generally designated 60 in FIGS. 8 and 9. Partially formed ground plate 60 includes two pair of positioning arms 60*a* and 60*b* similar to those described above as 50*a* and 50*b*. However, as can best be seen by comparing FIG. 5A to FIG. 8, the tips 62 of positioning arms 60*a* and 60*b* are not formed as far towards the plane of blade portion 42. As a result, the distance "d" between the tips of adjacent positioning arms is greater than the diameter of the portion of cable 40 across its metallic shield 56.

The aforementioned structure permits a stripped cable 40 to be moved transverse to its axis through the gap "G" between tips 62 of adjacent positioning arms. The stripped cable is then slid along blade portion 42 towards one of the positioning arms and away from the longitudinal centerline "L" of blade portion 42. This creates clearance to permit the insertion of a second stripped cable between tips 62 and into position adjacent the other positioning arm. Once two stripped cables have been positioned between a pair of positioning arms, that pair of positioning arms can be formed to retain the stripped cables in place while two cables are inserted in a like manner between the other pair of positioning arms. These other positioning arms are then likewise formed to retain the stripped cables so that the subassembly looks like that shown in FIG. 6A.

In the alternative, the positioning arms could be dimensioned to retain the cables between the arms without the forming process while the second pair of cables is inserted between the second pair of positioning arms. In that arrangement, both the positioning arms would be formed to the position shown in FIG. 6A in a single forming operation.

Ground plate 32 then is mechanically and electrically connected to metallic shields 56 of the coaxial cables by soldering the metallic shields to gripping arms 50*a* and 50*b* by applying solder through slots 48 in the gripping arms, as at "S" in FIGS. 6 and 7. As stated above, the slots are formed on the order of 0.040 inch wide to prevent the application of concentrated heat directly to the metallic shield, which could cause heat damage to the underlying inner dielectric. The slots should be sufficiently narrow to at least prevent whatever soldering iron or tool is used from passing through the slots and into direct engagement with the metallic shield. Such engagement may often result in damage to the underlying inner dielectric. In essence, the slots restrict the amount of soldering heat which is transmitted inwardly to the inner dielectric. On the other hand, with the slots extending in a circumferential direction and into blade portion 42 of the ground plate, the slots provide a large circumferential area of access to the metallic shields in a circumferential direction. Preferably, the slots extend at least approximately 180° around the respective coaxial cables.

Once the subassembly of FIG. 6 is fabricated, including the soldering procedures, this subassembly is assembled to terminal blocks 30*a* and 30*b* including high speed signal transmission terminals 38 to form terminal module 30 as shown in FIG. 7 and described above in relation to FIG. 2. Center conductors/cores 52 of the coaxial cables are then connected, as by soldering, welding or other means to the inner ends 38*a* of terminals 38, while terminal blocks 30*a* and 30*b* clamp blade portion 42 of ground plate 32 therebetween, as shown in FIG. 2 and described above. The terminal module then is mounted within dielectric housing 12 as shown in FIG. 2. If desired, terminal blocks 30*a* and 30*b* could be mounted to blade portion 42 of ground plate 32 prior to inserting cables 40 between gripping arms 50*a* and 50*b*. In such case, the ground plate 32 shown in FIG. 4 would have the terminal blocks mounted thereon at the beginning of the termination process.

In the alternative, it is believed that by using a coaxial cable having an inner dielectric that can withstand relatively high temperatures without deformation or degradation (such as aerated Teflon®), it may be possible to eliminate the slots 48 within gripping arms 50*a* and 50*b*. In such case, solder would be applied along the leading or trailing (or both) edges of the arms where they contact the shield braid 56. In still another alternate embodiment, arms 50*a* and 50*b* would not include slots 48 and some means on the inner surface of the arms 50*a* and 50*b* for applying solder between the arms and the cable braid 56 would be used. Such means could include a tin/lead plating, a solder topcoat or a solder inlay. The outer surface of the arms would be heated with a soldering iron or other tool, which would cause the plating, solder topcoat or solder inlay to flow, interconnecting the inner surface of the arms and the shield braid.

The concepts of the invention have been shown and described herein in conjunction with terminating the metallic shield of the coaxial cable to a terminating member 32 in the form of a ground plate 42. However, it should be understood that the concepts of the invention are equally applicable for terminating the metallic shield 56 to other types of terminating members, such as individual electrical terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages;

a ground member disposed at least partially within said housing relative to said terminals, said ground member including a termination portion for terminating said metallic shield of each of said cables to said ground member, said termination portion including a pair of gripping arms extending from said ground member, each of said gripping arms including an elongated slot and being adapted to be disposed about said exposed portion of said metallic shield of one of said cables in order to grip said exposed portion of said metallic shield without the deformation of said inner dielectric of said cable.

2. The electrical connector of claim 1 wherein said ground member includes a generally planar base and wherein said slot in each of said gripping arms extends from generally adjacent a distal end of said gripping arm to said planar base of said ground member.

3. The electrical connector of claim 1 wherein said ground member includes a generally planar base and wherein each of said gripping arms extends from a lateral edge of said base toward the other of said gripping arms whereby each of said gripping arms is adapted to extend arcuately about said exposed portion of one of said metallic shields such that said gripping arm and said base substantially encircle said exposed portion of said metallic shield disposed therein.

4. The electrical connector of claim 3 wherein said each of said gripping arms has an end portion spaced apart from the end portion of the other gripping arm to define a receiving gap, said receiving gap having a width at least of the diameter of said exposed portion of said metallic shield of each of said cables.

5. The electrical connector of claim 1 including at least one additional cable to be terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said electrical connector further includes a pair of additional gripping arms projecting from said termination portion, at least one of said additional gripping arms including an additional elongated slot and being adapted to be disposed about said additional exposed portion of said additional metallic shield of said additional cable in order to grip said additional exposed portion of said additional metallic shield without the deformation of said additional inner dielectric of said additional cable.

6. The electrical connector of claim 5 wherein said termination portion includes a generally planar base, wherein said gripping arms extends from a side of said base opposite to the side of said base from which said additional gripping arms extend and wherein said additional gripping arms are spaced longitudinally on said base from said gripping arms.

7. A termination assembly comprising:

a pair of cables, each of said cables having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shield is terminated, said terminal being at least partially disposed in a dielectric housing of an electrical connector and having a termination portion; and a pair of gripping arms projecting from said termination portion, each of said gripping arms being disposed about said exposed portion of said metallic shield of one of said cables so that said gripping arm and said termination portion substantially encircle said exposed portion of said metallic shield of said cable and grips said exposed portion of said metallic shield without deformation of said inner dielectric, each of said exposed portions of said metallic shields being bonded to said gripping arm in which said exposed portion is disposed.

8. The termination assembly of claim 7 wherein each of said gripping arms includes an elongated slot used in bonding said exposed portion of said metallic shield to said gripping arm.

9. The termination assembly of claim 8 wherein the opposed ends of each of said slots is curved to aid in the bonding of said exposed portion of said metallic shield to said gripping arm.

10. The termination assembly of claim 8 wherein said termination portion includes a generally planar base and wherein said slot in each of said gripping arms extends from generally adjacent a distal end of said gripping arm to said planar base of said termination portion.

11. The termination assembly of claim 8 wherein said exposed portions of said metallic shields are bonded to each of said gripping arms by soldering said exposed portion to said gripping arm using said slot in said gripping arm.

12. The termination assembly of claim 7 wherein said termination portion includes a generally planar base and wherein each of said gripping arms extends from a lateral edge of said base toward the other of said gripping arms such that each of said gripping arms extend arcuately about said exposed portion of one of said metallic shields to thereby grip said exposed portion of said metallic shield.

13. The termination assembly of claim 7 including at least one additional cable terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including a pair of additional gripping arms projecting from said termination portion, at least one of said additional gripping arms being disposed about said additional exposed portion of said additional metallic shield of said additional cable so that said additional gripping arm and said termination portion encircles a substantial portion of said additional metallic shield of said additional cable to thereby grip said additional metallic shield without deformation of said inner dielectric.

14. The termination assembly of claim 13 wherein said termination portion includes a generally planar base, wherein said additional gripping arms project from a side of said base opposite of the side from which said gripping arms project and wherein said additional gripping arms are spaced longitudinally on said base from said gripping arms.

15. The termination assembly of claim 13 wherein said termination portion includes a generally planar base, wherein each of said gripping arms includes a slot extending from generally adjacent a distal end of said gripping arm to said planar base of said termination portion, and wherein each of said additional gripping arms includes an additional slot extending from generally adjacent a distal end of said additional gripping arm to said planar base of said termination portion.

16. The termination assembly of claim 15 wherein said exposed portion of each of said metallic shields is bonded to one of said gripping arms by soldering said exposed portion to said gripping arm using said slot of said gripping arm and wherein said additional exposed portion of said additional metallic shield is bonded to one of said additional gripping arms by soldering said additional exposed portion to said additional gripping arm through said additional slot of said additional gripping arm.

17. A method of terminating a cable having an inner conductor, an inner dielectric surrounding said inner conductor, a metallic shield surrounding at least a portion of said inner dielectric and an outer insulating jacket surrounding at least a portion of said metallic shield to an electrical connector having a dielectric housing with a mating face, a termination face and a plurality of terminal receiving passages between said mating face and said termination face through which at least some passages extend a plurality of terminals and having a ground member at least partially disposed within said housing, said ground member including a mating portion generally adjacent said mating face and a ground termination portion generally adjacent said termination face, said method comprising the steps of:

providing said cable with a portion of said outer insulating jacket of said cable being removed from about said metallic shield so as to expose an exposed portion of said metallic shield;

positioning said exposed portion of said metallic shield relative to said termination portion so that said exposed portion of said metallic shield is positioned within a cable receiving area defined by a gripping arm extending from said ground member, said gripping arm being configured in a generally arc-shaped configuration;

forming said gripping arm into a gripping engagement with said exposed portion of said metallic shield without deformation of said inner dielectric; and bonding said exposed portion of said metallic shield to at least said gripping arm.

18. The method of claim 17 wherein said exposed portion of said metallic shield has a longitudinal axis and said cable is positioned within said cable receiving area prior to said gripping arm being formed by positioning said exposed portion at a location spaced from said cable receiving area and then moving said cable in the direction of said longitudinal axis into said cable receiving area.

19. The method of claim 17 wherein said gripping arm is formed circumferentially about said exposed portion of said metallic shield of said cable so that said gripping arm and said termination portion substantially encircle said exposed portion of said metallic shield.

20. The method of claim 17 wherein an elongated slot is provided in said gripping arm and said exposed portion of said metallic shield is bonded to said gripping arm by using said slot.

21. The method of claim 20 wherein said exposed portion of said metallic shield is bonded to said gripping arm by using said slot to apply solder to said exposed portion of said metallic shield.

22. The method of claim 21 wherein heat energy is applied through said slot to solder said exposed portion of said metallic shield to said gripping arm.

23. A method of terminating a pair of cables each of which cables having an inner conductor, an inner dielectric surrounding at least a portion of said inner conductor, a metallic shield surrounding at least a portion of said inner dielectric and an outer insulating jacket surrounding at least a portion of said metallic shield to an electrical connector having a dielectric housing with a mating face, a termination face and a plurality of terminal receiving passages between said mating face and said termination face through which at least some passages extend a plurality of terminals and having a ground member at least partially disposed in said housing, said ground member including a mating portion generally adjacent said mating face and a ground termination portion generally adjacent said termination face, said method comprising the steps of:

providing each of said cables with a portion of said outer insulating jacket of said cable being removed from about said metallic shield so as to expose an exposed portion of said metallic shield;

positioning said exposed portion of each of said metallic shields relative to said termination portion so that said exposed portion of said metallic shield of each of said cables is positioned within one of a pair of cable receiving areas, each of said cable receiving areas being defined by a gripping arm extending from said ground member with each of said gripping arms being configured in a generally arc-shaped configuration and extending toward each other;

forming each of said gripping arms into gripping engagement with said exposed portion of said metallic shield of said cable disposed within said cable receiving area defined by said gripping arm without deformation of said inner dielectric; and bonding each of said gripping arms to said exposed portion of said metallic shield disposed within said cable receiving area defined by said gripping arm.

24. The method of claim 23 wherein said exposed portion of said metallic shield of each of said cables has a longitudinal axis and each of said cables is positioned within a respective one of said cable receiving areas by positioning said exposed portion of said metallic shield at a location spaced from said respective cable receiving area and then moving said cable in a direction of its longitudinal axis into said respective cable receiving area.

25. The method of claim 23 wherein said ground member includes a generally planar base and wherein said gripping arms extend from opposite edges of said base and towards each other, each of said gripping arms having an end portion spaced apart from the end portion of the other gripping arm to define a receiving gap of sufficient width to permit said exposed portions of said metallic shields of said cables to pass between said spaced apart end portions so that said exposed portions of said metallic shields of said cables can be positioned within said cable receiving areas.

26. The method of claim 25 wherein said exposed portion of said metallic shield of each of said cables is moved through said receiving gap in a direction generally transverse to said planar base and then said exposed portion of said metallic shield is positioned within said cable receiving area formed by one of said gripping arms.

27. The method of claim 23 wherein each of said gripping arms is formed circumferentially about one of said exposed portions of said metallic shields of said cables so that each of said gripping arms and said termination portion substantially encircle said exposed portion of said metallic shield of one of said cables.

28. The method of claim 23 wherein an elongated slot is provided in each of said gripping arms and said exposed portion of said metallic shield of each of said cables is bonded to one of said gripping arms by using said slot.

29. The method of claim 28 wherein said exposed portion of said metallic shield is bonded to said gripping arm by using said slot to apply solder to said exposed portion of said metallic shield.

30. The method of claim 29 wherein heat energy is applied through said slot to solder said exposed portion of said metallic shield to said gripping arm.

31. The method of claim 23 further including terminating said inner conductor of each of said cables to one of said terminals and forming said ground member with said metallic shields bonded thereto and said terminals with said inner conductors terminated thereto into a subassembly for disposition in said housing.

32. The method of claim 23 wherein at least one additional cable is to be terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said method further includes positioning said additional exposed portion of said additional metallic shield relative to said termination portion so that said additional exposed portion of said additional metallic shield of said additional cable is positioned within one of a pair of additional cable receiving areas, each of said additional cable receiving areas being defined by an additional gripping arm extending from said termination portion with each of said additional gripping arms being configured in a generally arc-shaped configuration and extending toward each other and including forming at least one said additional gripping arms into gripping engagement with said additional exposed portion of said additional metallic shield of said additional cable disposed within said additional cable receiving area defined by said additional gripping arm without deforming said additional inner dielectric.

33. The method of claim 32 further including bonding said additional gripping arm to said additional exposed portion of said additional metallic shield disposed within said additional cable receiving area of said additional gripping arm.

34. The method of claim 32 wherein said termination portion includes a generally planar base, wherein said additional gripping arms project from a side of said base opposite of the side from which said gripping arms project and wherein said additional gripping arms are spaced longitudinally on said base from said gripping arms.

35. The method of claim 32 wherein said termination portion includes a generally planar base, wherein each of said gripping arms includes a slot extending from generally adjacent a distal end of said gripping arm to said planar base of said termination portion, and wherein each of said additional gripping arms includes an additional slot extending from generally adjacent a distal end of said additional gripping arm to said planar base of said termination portion.

36. The method of claim 35 wherein said exposed portion of each of said metallic shields is bonded to one of said gripping arms by soldering said exposed portion to said gripping arm using said slot of said gripping arm and wherein said additional exposed portion of said additional metallic shield is bonded to one of said additional gripping arms by soldering said additional exposed portion to said additional gripping arm through said additional slot of said additional gripping arm.

37. The method of claim 36 wherein heat energy is applied through said slot to solder said exposed portion of said metallic shield to said gripping arm and heat energy is applied through said additional slot to solder said additional exposed portion of said additional metallic shield to said additional gripping arm.

38. The method of claim 32 wherein said exposed portion of said metallic shield of each of said cables has a longitudinal axis and each said cables is positioned within a respective one of said cable receiving areas by positioning said exposed portion of said metallic shield at a location spaced from said respective cable receiving area and then moving said cable in a direction of its longitudinal axis into said respective cable receiving area and wherein said additional exposed portion of said additional metallic shield of said additional cable has an additional longitudinal axis and said additional cable is positioned within said additional cable receiving area by positioning said additional exposed portion of said additional metallic shield at a location spaced from said respective additional cable receiving area and then moving said additional cable in a direction of its additional longitudinal axis into said additional cable receiving area.

39. The method of claim 32 wherein said ground member includes a generally planar base, wherein said gripping arms extend from opposite edges of said base and towards each other, each of said gripping arms having an end portion spaced apart from the end portion of the other gripping arm to define a receiving gap of sufficient width to permit said exposed portions of said metallic shields of said cables to pass between said spaced apart end portions as said metallic shields of said cables are being positioned within said cable receiving areas and wherein said exposed portions of said metallic shields of said cables are moved through said receiving gap in a direction generally transverse to said planar base so that said exposed portion of said metallic shield can be positioned within said cable receiving area adjacent said gripping arm and wherein said additional gripping arms extend from opposite edges of said base on a side opposite from the side from which said gripping arms extend and towards each other, each of said additional gripping arms having an additional end portion spaced apart from the additional end portion of the other additional gripping arm to define an additional receiving gap of sufficient width to permit said additional exposed portion of said additional metallic shield of said additional cable to pass between said spaced apart additional end portions as said additional metallic shield of said additional cable is being positioned within said additional cable receiving area and wherein said additional exposed portion of said additional metallic shield of said additional cable is moved through said additional receiving gap in a direction generally transverse to said planar base so that said additional exposed portion of said additional metallic shield can be positioned within said additional cable receiving area adjacent said additional gripping arm.

40. The method of claim 32 wherein each of said gripping arms is formed circumferentially about a substantial portion of said exposed portion of said metallic shield of said cable to which said gripping arm is gripped and at least one of said additional gripping arms is formed circumferentially about a substantial portion of said additional exposed portion of said additional metallic shield of said additional cable to which said additional gripping arm is gripped.

41. The method of claim 32 further including terminating said inner conductor of each of said cables to one of said terminals and terminating said additional inner conductor of said additional cable to one of said terminals and forming said ground member with said metallic shields and said additional metallic shield bonded thereto and said terminals with said inner conductors terminated thereto into a subassembly for disposition in said housing.

* * * * *